US005269471A

United States Patent [19]

Yamagishi

[11] Patent Number: 5,269,471

[45] Date of Patent: Dec. 14, 1993

[54] PULVERIZER

[75] Inventor: Takashi Yamagishi, Fujisawa, Japan

[73] Assignee: Turbo Kogyo Co., Ltd., Yokosuka, Japan

[21] Appl. No.: 972,571

[22] Filed: Nov. 6, 1992

[30] Foreign Application Priority Data

Jan. 21, 1992 [JP] Japan ..... 4-030133

[51] Int. Cl.[5] ..... B02C 23/38

[52] U.S. Cl. ..... 241/27; 241/228; 241/261.1

[58] Field of Search ..... 241/228, 260, 261.1, 241/27

[56] References Cited

U.S. PATENT DOCUMENTS

| | | | |
|---|---|---|---|
| 1,040,876 | 10/1912 | Buxton | 241/228 |
| 1,607,404 | 11/1926 | Low | 241/228 X |
| 1,807,773 | 3/1931 | Dawson | 241/261.1 |
| 2,888,213 | 5/1959 | Hübner et al. | 241/260 |
| 3,102,694 | 9/1963 | Frenkel | 241/261.1 X |
| 3,305,180 | 2/1967 | Tomlinson | 241/260 X |
| 3,547,356 | 12/1970 | Asplund | 241/260 X |
| 3,610,542 | 10/1967 | Yamagishi . | |
| 4,562,972 | 1/1986 | Hagiwara et al. | 241/260 |

FOREIGN PATENT DOCUMENTS

| | | | |
|---|---|---|---|
| 923470 | 2/1955 | Fed. Rep. of Germany | 241/228 |
| 2812958 | 10/1978 | Fed. Rep. of Germany | 241/228 |
| 116536 | 1/1877 | France | 241/260 |
| 359596 | 2/1962 | Switzerland | 241/260 |
| 1388497 | 4/1988 | U.S.S.R. | 241/261.1 |

*Primary Examiner*—Mark Rosenbaum
*Assistant Examiner*—Frances Chin
*Attorney, Agent, or Firm*—Price, Heneveld, Cooper, DeWitt & Litton

[57] ABSTRACT

A plurality of recesses, each having a semicircular section, are formed close to each other in the inner surface of a cylindrical housing so that these recesses extend parallel to the axis of the housing. The inner surface of the housing, a portion of a circle which is part of each recess, and the ends of the vanes of a rotor are provided starting from the curvature centers of the semicircular recesses to the axial center of the housing.

13 Claims, 6 Drawing Sheets

PULVERIZER

BACKGROUND OF THE INVENTION

The present invention relates to a pulverizer for obtaining fine powder, such as toner used for copying machines. More particularly, it pertains to a pulverizer comprising a housing and a rotor.

Pulverizers typically include a housing having an inner surface in which a large number of recesses are formed parallel to a center line running through the axis of the housing. The rotor is attached to a rotary shaft rotating at high speed around the center line, and has vanes or projections extending parallel to the center line so that there is a small space between the inner surface of the housing and the ends of the vanes. In such a structure, a powdered raw material, together with a large amount of air, is fed through an inlet at one end of the housing, and is pulverized and discharged through an outlet at the other end.

As shown in FIG. 8, a pulverizer conventionally includes a housing 16 and a rotor 18. The housing 16 is provided with an inner surface having a large number of recesses 17, each forming a triangle when viewed in section. Vanes or projections 19 are formed in the surface of the cylindrical rotor 18 so that there is a small space between the inner surface of the housing and the ends of the vanes.

A cyclone, a bug filter and an exhauster are connected in series to the back of the pulverizer. The exhauster blows air through the inside of the pulverizer.

Because of the many vanes or projections of the rotor rotating at high speed, an air stream of high velocity is generated around the outer periphery of the rotor and flows in the rotational direction of the rotor. The air stream is compressed when the ends of the vanes or projection approach the ridges between the recesses facing the rotor, and is expanded when the ends move away from the ridges. High-frequency vibrations are thus generated.

The powdered raw material fed into the pulverizer strikes against the vanes or projections and is accelerated. It then strikes against the surfaces of the recesses in the inner surface of the housing, which surfaces oppositely face a direction in which the rotor rotates, whereby it is pulverized into fine powder and then into finer powder by the high-frequency pressure vibrations generated around the outer periphery of the rotor. The pulverized powder, together with air, which has been discharged from the pulverizer is collected by the cyclone and the bug filter.

In recent years, there has been a demand for a toner for copying machines, 50% of which toner has a particle diameter of 10 microns or less which is finer than conventional toners. To obtain such fineness, the space between the rotor and the inner surface of the housing is made smaller, and the peripheral speed of the ends of the rotor is increased to 110–125 m/s.

The temperatures of the air and pulverized powder discharged from the inside of the pulverizer is increased significantly because of the tremendous disturbance of the air inside the pulverizer, the frictional loss of air caused when the high-frequency pressure vibrations occur, and because powder which has already been pulverized into the desired size strikes the vanes repeatedly.

It is necessary that the temperatures of the air and powder discharged from the pulverizer be maintained at about 50° C. or less so that the powdered raw material cannot melt inside the pulverizer.

If the amount of air supplied to the unit weight of the powdered raw material is increased in order to limit the air and powder to the above temperature, the time is shortened during which the material is pulverized inside the pulverizer, thus resulting in incomplete pulverization.

The object of the present invention is to provide a pulverizer capable of remarkably increasing the amount of powder to be pulverized per unit time when the flow rate and temperature of air supplied to the pulverizer, and the temperatures of the air and pulverized powder are under predetermined conditions; and when powder having the same size as powder pulverized conventionally is produced at the peripheral speed of the rotor which is substantially equal to the peripheral speed of the rotor of the conventional pulverizer. The pulverizer of this invention is further capable of increasing the peripheral speed of the rotor to pulverize the powder into finer particles than powder obtained conventionally even when the powder is pulverized at the same ratio.

SUMMARY OF THE INVENTION

The present invention provides a pulverizer in which the inner surface of a cylindrical housing has ceiling portions which extend parallel to a center line running through the axis of the housing and have substantially semicircular sections when viewed from the side of the housing. The radius of the inner surface of the housing is shorter than the radius which extends from the axial center of the housing to the curvature center of each semicircular ceiling portion. A portion of a circle which is drawn using the curvature center of each semicircular ceiling portion is formed as a recess which has an arch-shaped section projecting into a torus. The outer periphery of the torus is the radius of the inner surface of the housing, whereas the inner periphery of the torus is the radius of the vanes or projections of the rotor. Many of such recesses are formed close to each other.

A high-velocity air stream is generated around the outer periphery of the rotor rotating at high speed and flows in the same direction as the rotational direction of the rotor. The air stream is in contact with air inside the recesses, each of which recess has the semicircular ceiling portion and the arch-shaped section formed in the inner surface of the cylindrical housing. Therefore, when the air inside each recess is accelerated, air having a very high angular velocity is generated in a direction opposite to that in which the rotor rotates.

Extreme high-frequency vibrations are generated in the high-velocity air stream flowing around the outer periphery of the rotor because of the presence of sharp ridges and the vanes or projections of the rotor. The sharp ridges facing the rotor are formed between the recesses in the inner surface of the housing. The rotor rotates at high speed in the small space between the ridges and the vanes of the rotor.

A powdered raw material fed into the pulverizer strikes against the vanes or projections of the rotor, thereby being pulverized, or it strikes against the vanes and is accelerated and strikes against the surfaces of the recesses having the arch-shaped sections, which surfaces oppositely face a direction in which the rotor rotates, thereby being pulverized. The pulverized powder enters the air stream flowing toward the outlet of the pulverizer while it is circulating rapidly inside the recesses. It is subjected to centrifugation because of the air circulating around the curvature center of each recess. Coarse powder is thrown out from the recesses, whereas powder which has been pulverized into fine particles, flows from the recesses toward the outlet.

The powder which has been thrown out from the recesses again strikes against the vanes and is thereby pulverized, or it is again pulverized by the extreme high-frequency vibrations generated in the air stream flowing around the outer periphery of the rotor. The powder subjected to the centrifugation and pulverized into fine particles is carried away by the air stream flowing in the recesses toward the outlet through which the powder is immediately discharged.

These and other features, advantages, and objects of the present invention will be further understood and appreciated by those skilled in the art by reference to the following specification, claims, and appended drawings.

DESCRIPTION OF THE PREFERRED EMBODIMENTS

Figure 1:
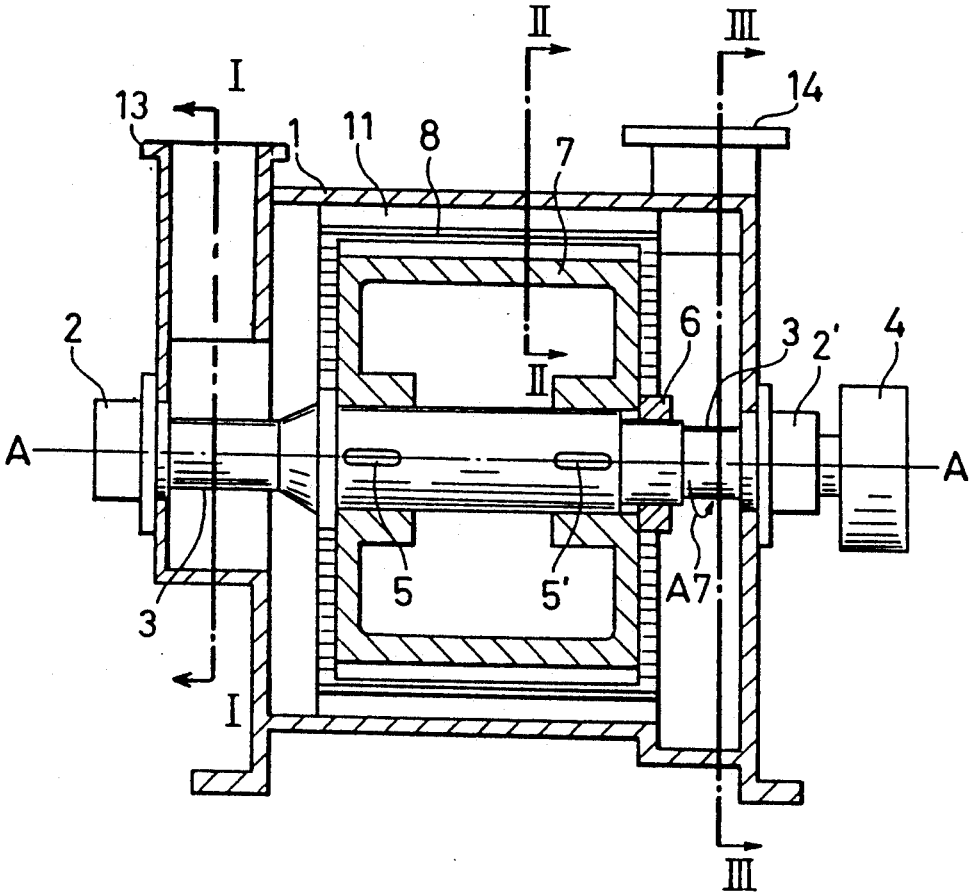
FIG. 1 is a longitudinal sectional view showing an embodiment of a pulverizer according to the present invention.
Figure 2:
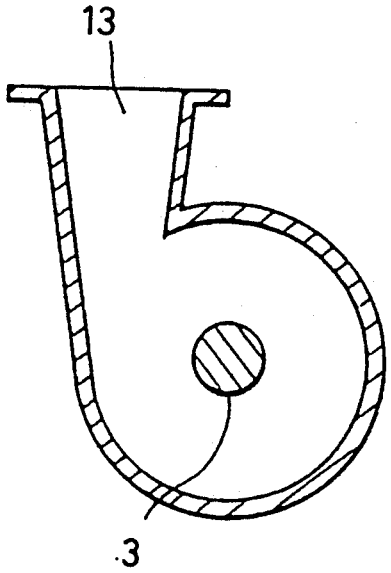
FIG. 2 is a vertical sectional view taken along line I—I of FIG. 1.

The embodiments of the present invention will be described with reference to FIGS. 1 through 4.

A rotary shaft 3 is disposed along a line A—A (hereinafter referred to a center line) running through the axis of a cylindrical housing 1 and is rotatably supported by bearings 2 and 2'. The rotary shaft 3 is rotated at high speed in the direction indicated by arrow A7 by a belt fitted over a pulley 4 which is fixed to one end of the shaft 3.

A large number of vanes or projections 8 having a radius R1 are radially formed in the surface of a cylindrical rotor 7 so as to extend parallel to the center line A—A. The rotor 7 is secured to the rotary shaft 3 by keys 5 and 5', and a nut 6.

Figure 3:
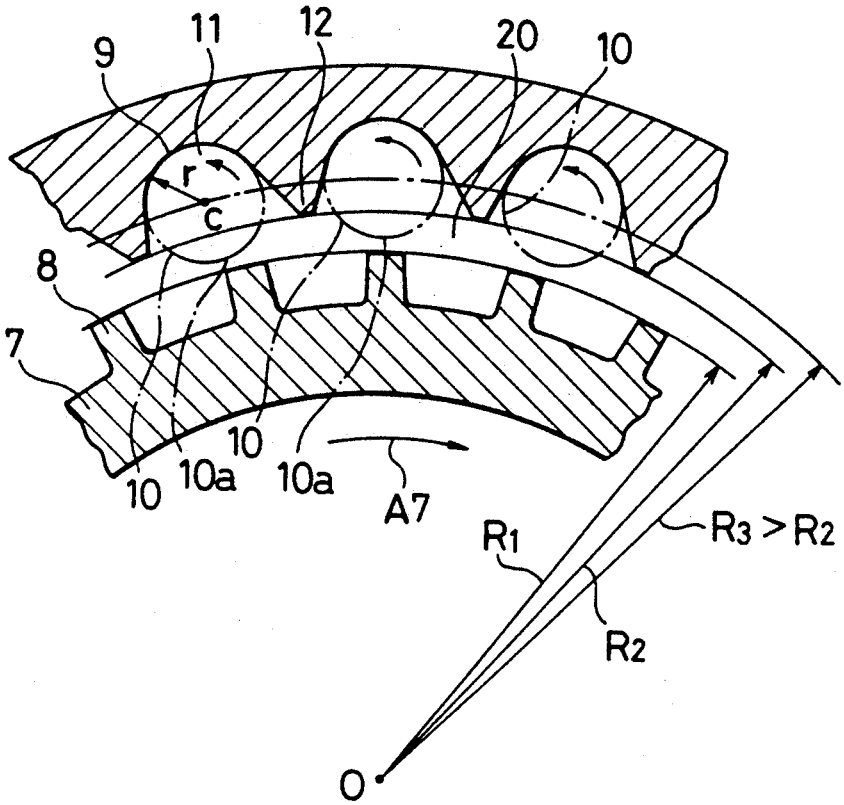
FIG. 3 is a vertical sectional view vertical sectional view taken along line II—II of FIG. 1.
Figure 4:
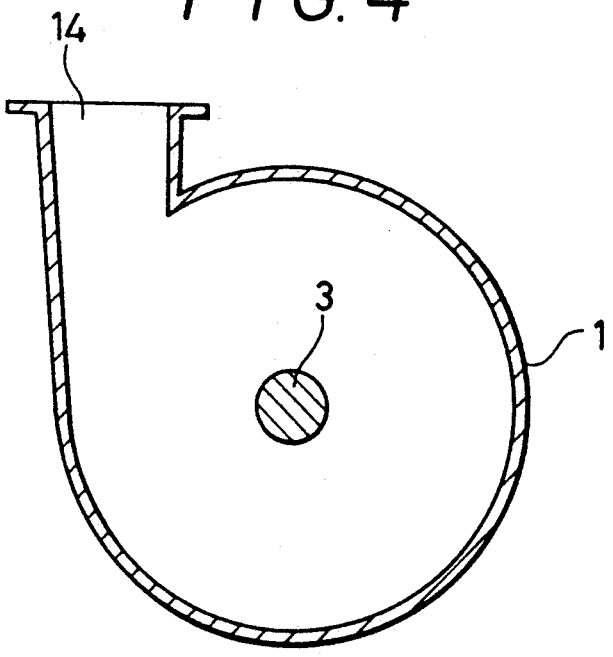
FIG. 4 is a vertical sectional view taken along line III—III of FIG. 1.

Substantially semicircular ceiling portions 9 extending parallel to the center line A—A are formed in the inner surface of the housing 1 which has a radius R2. FIG. 3 illustrates the sections of the semicircular portions 9 when viewed from the bearing 2 shown in FIG. 1. As shown in FIG. 3, the radius R2 of the inner surface of the housing 1 is shorter than the radius R3 which extends from the axial center O (i.e. centerline A—A) of the housing 1 to the curvature center C of each semicircular portion 9. Portions of circles 10 are formed as recesses 11, each having an arch-shaped section. Each circle 10 is drawn using the curvature center C of each semicircular portion 9 and the curvature radius r thereof. For example, arcs 10*a* situated closest to the axial center O of the housing 1 project into a torus defined by the radius R1 of the vanes 8 and the radius R2 of the inner surface of the housing 1. Sharp ridges 12 are formed between the recesses 11.

As illustrated in FIG. 3, ridges 12 are spaced slightly farther apart than projections 8. For example, the center projection 8 in FIG. 3 is centered on the corresponding semicircular portion 9 located above the projection, while the adjacent projections 8 on either side thereof are not centered on the respective semicircular portions 9 located above them, but rather are located slightly closer together. Due to the uniform spacing of projections 8 around rotor 7 and also of ridges 12 around housing 1, this spacing results in more total projections 8 around rotor than total ridges 12 in housing 1.

An inlet 13 is provided at one end of the housing 1, and an outlet 14 is provided at the other end. A cyclone, a bug filter and an exhauster are connected by piping in series to the outlet 14.

Because of the presence of the vanes or projections 8 of the rotor 7 rotating at high speed, the ends of vanes or projections 8 rapidly move close and then away from the ridges 12 between the recesses 11. Extreme high-frequency pressure vibrations are thereby generated in an air stream circulating around the rotor 7.

A powdered raw material, together with air, is fed through the inlet 13, and strikes against the vanes or projections 8 of the rotor 7, thereby being pulverized, or it is accelerated and strikes against the surfaces of the recesses 11, which surfaces face a direction A7 in which the rotor 7 rotates. Then the powdered raw material enters the air stream circulating rapidly at the curvature center C of each recess 11. While the powdered raw material is circulating at the curvature center C, coarse powder is thrown out from the recesses 11 by centrifugal force. The thrown powder again strikes against the vanes or projections 8 in the same manner as described above, or it is further pulverized into finer powder because of the extreme pressure vibrations in the air stream circulating around the rotor 7.

Powder which has been pulverized is thrown out from the recesses 11 by the centrifugal force, and again enters the recesses 11 so as to enter the air stream circulating at the curvature centers C, thus circulating in the air stream. Powder which has been pulverized thoroughly by centrifugation flows toward the outlet 14 while it in the circulating air stream, and is discharged therethrough.

An embodiment of this invention has been described with reference to FIGS. 1 through 4. This invention, however, is not limited to such an embodiment. It is possible within the scope of this invention to modify the structure thereof and to add other structures thereto.

For example, as in the embodiment shown in FIG. 3, each circle 10 is drawn so that a portion thereof closest to the axial center of the housing 1 has the arc 10*a*. Each circle 10 is drawn using the curvature radius r and projects into the torus 20 defined by the radius R1 of the vanes of the rotor and the radius R2 of the inner surface of the housing 1. As shown in the embodiment of FIG. 5, it is possible that each circle be drawn so that a portion thereof closest to the axial center of the housing has arcs 10*b* and 10*c*.

Figure 5:
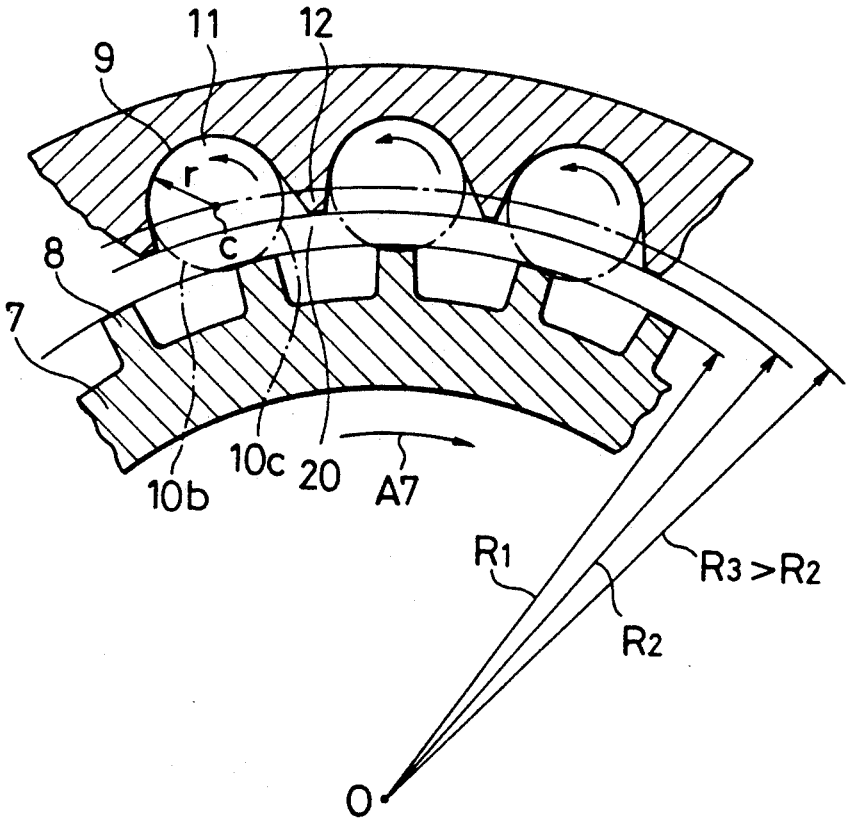
FIG. 5 is a vertical sectional view of another embodiment, taken along a plane corresponding to that of FIG. 3.
Figure 6:
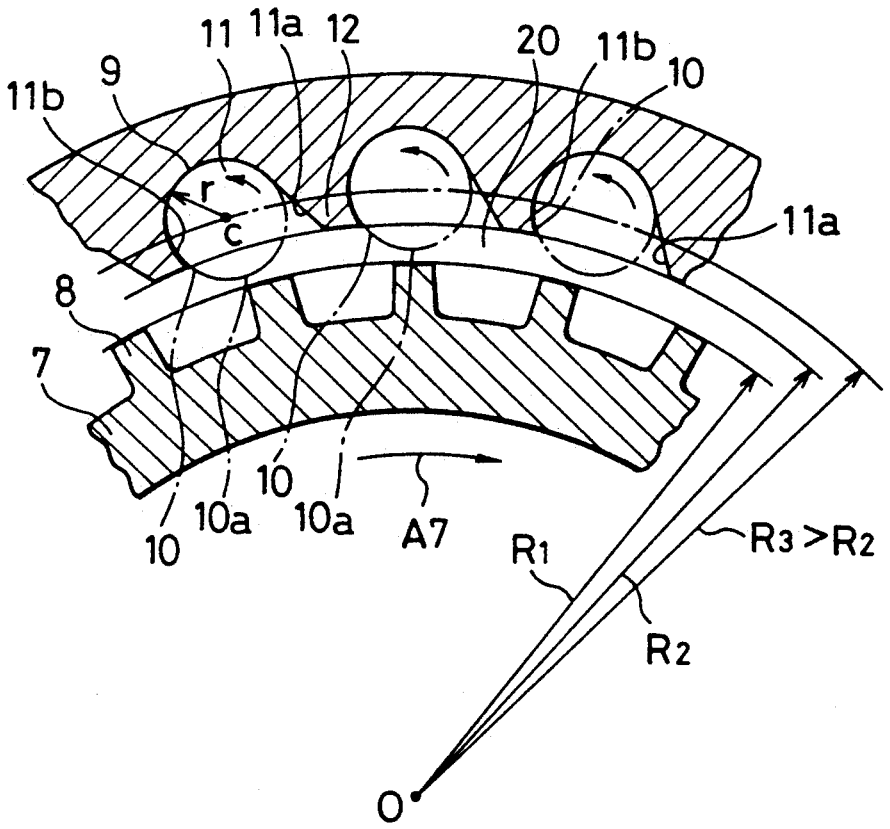
FIG. 6 is a vertical sectional view of still another embodiment, taken along a plane corresponding to that of FIG. 3.
Figure 7:
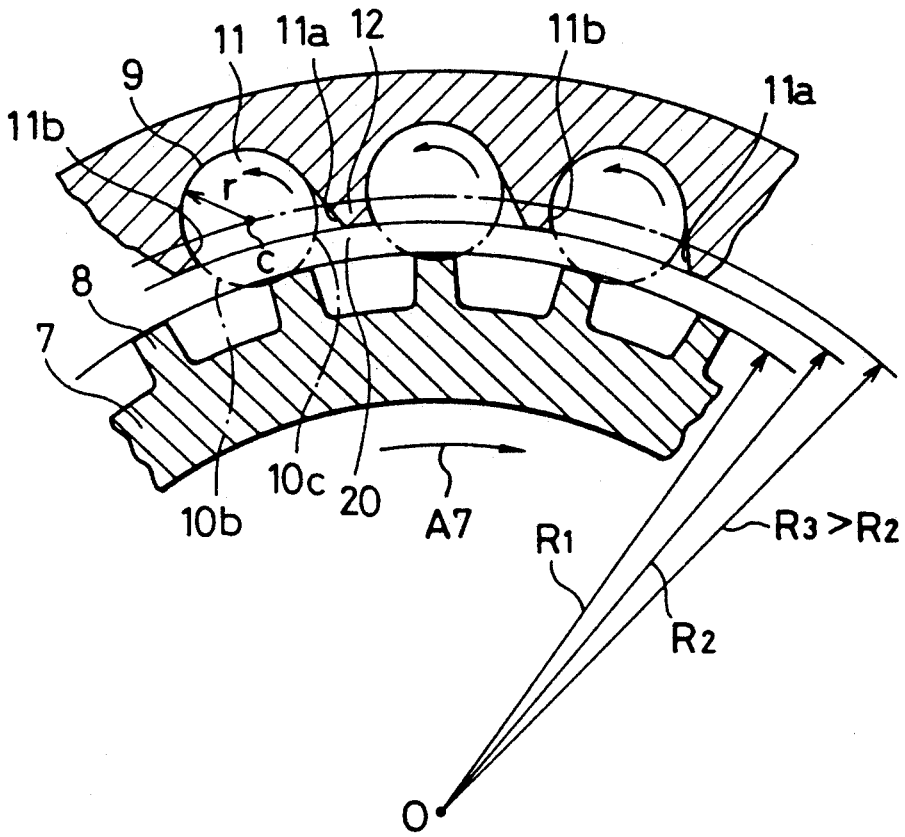
FIG. 7 is a vertical sectional view of still another embodiment, taken along a plane corresponding to that of FIG. 5.
Figure 8:
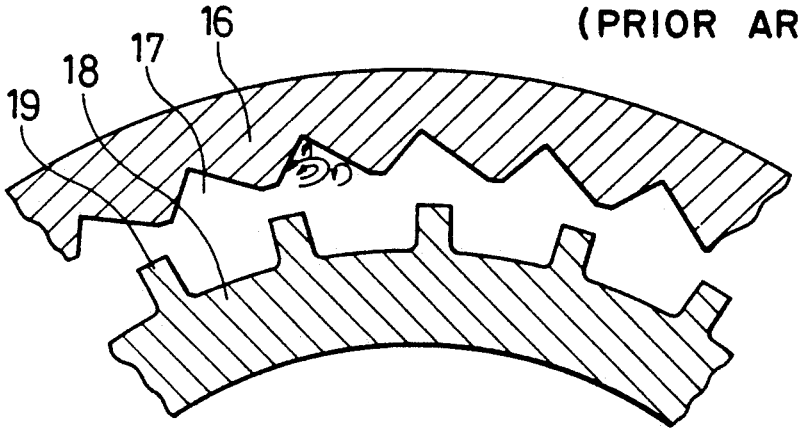
FIG. 8 (PRIOR ART)
FIG. 8 is a vertical sectional view showing a conventional art.

In each of the embodiments shown in FIGS. 5 and 3, the recesses 11 are radially formed in the inner surface of the housing 1, so that the wall surfaces 11*a* and 11*b* defining the inlet and the outlet of each recess are gradually spaced apart from the circle 10 as the distance from the rotor 7 decreases. This, however, is not essential and the arrangement may be such that, as shown in FIGS. 6 and 7, the wall surface 11*b* defining the outlet of the recess 11 exactly follows the circle 10, i.e., conforms with a part of the arc of the circle 10. Such an arrangement effectively prevents invasion of the recess 11 by the stream of air which is generated when the rotor 7 rotates in the direction of the arrow A7. Consequently, disturbance of the centrifugal classifying region is suppressed to sharpen the coarse and fine powders and, at the same time, the chance for the coarse powder to be repulverized is enhanced to further improve the precision of pulverization.

According to this invention, since the recesses, each having an arch-shaped section, are formed in the inner surface of the stationary housing, an air stream is obtained which stably circulates around the curvature center of the recesses. The circulating air stream flows from the inlet to the outlet of the housing so as to be parallel to the center line of the housing.

Because of the above structure, coarse powder circulating in the air stream is thrown out from the recesses, thus striking against the surface of the rotor, whereby it is again pulverized. Powder which has been pulverized into finer particles, together with air, is discharged through the outlet without any trouble. The space between the rotor and the inner surface of the cylindrical housing does not interfere with the coarse powder during its pulverization. The frequency is markedly reduced with which energy supplied from a motor to the rotor is wasted and heat is generated because the pulverizer is operated repeatedly and unsmoothly, and the powder is pulverized into particles which are too small.

It is possible to prevent the production of harmful micronized powder produced when it is pulverized into particles which are too small. Thus, the amount of energy supplied to the powdered raw material per unit weight is less than the amount supplied to the powdered raw material pulverized by conventional pulverizers.

When the same powder having the same size is pulverized by the pulverizer of this invention and the conventional pulverizer under the same conditions where the temperature and the flow rate of air fed into the pulverizes are the same, the flow rate of air flowing out of the pulverizes is the same, and the peripheral speed of the rotors is the same, then it is possible for the pulverizer of this invention to remarkably increase the amount the powder is pulverized per unit time.

The peripheral speed of the rotor of the pulverizer according to this invention can be increased more than that of the conventional rotor. The pulverizer of this invention makes it possible to pulverize powder into a smaller size than that of powder obtained by the conventional art without causing the powdered raw material to melt inside the pulverizer even when the powder is pulverized at the same ratio as in the conventional manner.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A method of pulverizing powdered raw material comprising:

providing a pulverizer having a housing and a rotatably mounted rotor, the housing including an inner surface with longitudinally extending recesses and the rotor including longitudinally extending vanes positioned to closely pass by but clear the housing inner surface, the recesses including a cross-sectional shape that is at least partially circular in shape, each said cross-sectional shape being a part of a circle, said circle defining a circular tubular shape extending inwardly from said inner surface short of the vanes when the rotor is rotated;

rotating the rotor so as to cause air in the recesses to angularly rotate in a direction opposite the rotor and in substantially a circular pattern when viewed from an end of the rotor;

introducing a high volume of airborne powdered raw material of varied particle size into the recesses and into the space between the rotor and the housing inner surface, whereby the angularly rotating air and airborne powdered raw material in each of the recesses moves in a spiral path as they move through the pulverizer so as to throw any oversized particles from the recesses into the rotor but also so as to safely convey any undersized particles or particles of desired size through the pulverizer, thus providing a more efficient pulverizer and a more uniform final powder particle size as the pulverized powdered raw material exits the housing.

2. A pulverizer comprising a cylindrical housing having an inner surface with a large number of ridges defining recesses therebetween that extend generally parallel to a center line of the housing, and a rotor attached to a rotary shaft adapted to rotate at high speed on the center line, the rotor having vanes extending generally parallel to the center line, the vanes and ridges including ends defining a small space therebetween as the rotor is rotated, the recesses each including an elongate arcuate surface that defines a portion of a circle when viewed in cross-section perpendicular to said housing center line and further including inclined inlet and inclined outlet surfaces to said elongate arcuate surface, portions of each said circle extending into said small space short of said vanes as said rotor is rotated, whereby powdered raw material fed into said small space and said recesses with a large amount of air moves in a circular pattern in said recesses and centrifugally separates into particles of acceptable size and oversized particles, the particles of acceptable size flowing along the circular pattern within the circles defined by the recesses, but the oversized particles being thrown by centrifugal force out of the circular pattern into said ridges wherein the oversized particles are further pulverized, thus allowing the pulverizer to operate at high volumes and rotor speeds.

3. A pulverizer comprising a cylindrical housing having opposing ends and an inner surface with a large number of recesses parallel to a center line of the housing and a rotor attached to a rotary shaft rotating at high speed around the center line and having vanes parallel to the center line so that there is a small space between the inner surface of the housing and the ends of the vanes, the inner surface of the cylindrical housing having ridges that extend parallel to said center line, said ridges defining arcuately shaped surfaces therebetween when viewed from a side of the housing, said arcuately shaped surfaces each being a part of a circle in cross-section and defining a center line in each said recess, each said circle having a radius defining an elongated tubularly shaped flow path extending the length of said recess, the distance between the loci of said recess center lines and the axial center of the housing being longer than the distance between said ridges and the axial center of the housing, wherein the large number of recesses are provided close to each other so that said circle of each arcuately shaped surface projects into said small space short of the path of said vanes as the vanes are rotated, whereby a powdered raw material fed into one end of the housing with a large amount of air is pulverized and discharged out of the other end of the housing with oversized particles being continuously centrifugally thrown out of the plurality of elongated tubularly shaped flow paths against said vanes for additional pulverizing while acceptably sized particles are generally retained in and carried through said plurality of elongated tubularly shaped flow paths and discharged.

4. A pulverizer according to claim 3 wherein the recess includes wall surfaces defining an inlet and an outlet that are so formed as to diverge from said circle as the distance from said rotor decreases.

5. A pulverizer according to claim 3 wherein the recess includes a wall surface defining an outlet that is so formed as to conform with a part of the arc of said circle.

6. A pulverizer according to claim 3 wherein the portion of the circle drawn by using the radius of each arcuately shaped surface is an arc located in said small space and situated closer to the axial center of said cylindrical housing than a remaining part of the circle.

7. A pulverizer according to claim 6 wherein said arcs include equal segments situated on both sides of a point on said arc located closest to the axial center of said cylindrical housing.

8. A pulverizer comprising:

a housing having a cylindrically-shaped inner surface;

a rotor rotatably mounted in said housing including vanes with ends located close to but spaced from said inner surface thus defining a space therebetween, said rotor defining an axis of rotation and said vanes extending generally in the direction of said axis of rotation;

said inner surface defining a plurality of recesses extending generally in the direction of said axis of rotation, each of said recesses having an arcuately shaped portion when viewed in cross-section, said arcuately shaped portion being a part of a circular, tubular shape that extends inwardly from said inner surface into said space but short of said ends of said vanes, said circular tubular shape defining the boundaries of a spiral path which powdered raw material takes when pulverized to a desired particle size during operation of the pulverizer, said ends of said vanes when rotated passing close to but short of said circular tubular shape so as to cause powdered raw material contained in the pulverizer to move in a circular flow pattern within said circular tubular shape, said recesses including an inlet surface and an outlet surface that diverge from said circular tubular shape to enhance the circular flow pattern of the powdered raw material;

means for introducing powdered raw material of varied particle size and fluid means carrying the powdered raw material into said plurality of recesses and said space; and means for removing pulverized powdered raw material and fluid means from said plurality of recesses and said space; whereby powdered raw material of varied particle size can be fed into the pulverizer so that the portion of powdered raw material having less than a desired particular size travels in a spiral path within said circular tubular shape, but the portion of powered raw material having a size greater than the desired particular size is thrown by centrifugal force out of the circular tubular shape into the rotor vanes so that the oversized particles are pulverized and then reintroduced into another spiral path in one of the circular tubular shapes.

9. A pulverizer as defined in claim 8 wherein the depth of said vanes is less than the depth of said recesses.

10. A pulverizer as defined in claim 8 wherein said inlet surface and said outlet surface are each planar and tangential to said arcuately shaped portion of said recess so that said surfaces direct the material of the desired particle size into the spiral path in one of the tubular shapes for safe passage and direct the material of greater than the desired particle size into the vane ends for pulverizing.

11. A pulverizer as defined in claim 8 wherein each of said recesses includes an inlet surface and an outlet surface to said arcuately shaped portion, said inlet surface and said outlet surface being shaped with an incline adapted to cause an angularly rotating fluid flow in said circular tubular shapes when said rotor is rotated.

12. A pulverizer as defined in claim 8 wherein said vanes are spaced apart a different amount than said recesses.

13. A pulverizer as defined in claim 8 wherein each of said recesses includes a wall surface defining the outlet surface that is planar and tangential to said arcuately shaped portion of said recess.

* * * * *